US010383486B2

(12) United States Patent
Nichols

(10) Patent No.: US 10,383,486 B2
(45) Date of Patent: Aug. 20, 2019

(54) HANDHELD MOTORIZED FACIAL BRUSH HAVING THREE FLOATING HEADS

(71) Applicant: Thomas Nichols, Laguna Niguel, CA (US)

(72) Inventor: Thomas Nichols, Laguna Niguel, CA (US)

( * ) Notice: Subject to any disclaimer, the term of this patent is extended or adjusted under 35 U.S.C. 154(b) by 965 days.

(21) Appl. No.: 14/926,299

(22) Filed: Oct. 29, 2015

(65) Prior Publication Data

US 2017/0119220 A1 May 4, 2017

(51) Int. Cl.

| | |
|---|---|
| ***A47K 7/04*** | (2006.01) |
| ***A46B 13/00*** | (2006.01) |
| ***A46B 13/02*** | (2006.01) |
| ***A46B 15/00*** | (2006.01) |
| ***A61H 15/00*** | (2006.01) |

(52) U.S. Cl.

CPC ..... *A47K 7/043* (2013.01); *A46B 13/008* (2013.01); *A46B 13/023* (2013.01); *A46B 15/0044* (2013.01); *A47K 7/04* (2013.01); *A61H 15/0085* (2013.01)

(58) Field of Classification Search

CPC ..... A47K 7/043; A47K 7/04; A46B 13/008; A46B 13/023; A46B 15/0044; A61H 15/0085

See application file for complete search history.

(56) References Cited

U.S. PATENT DOCUMENTS

| | | | | |
|---|---|---|---|---|
| 1,577,751 | A * | 3/1926 | Paschall | A61H 7/004 15/22.1 |
| 2,424,699 | A | 7/1947 | Marty | |
| 3,710,785 | A | 1/1973 | Hilger | |
| 5,007,168 | A | 4/1991 | Messinger et al. | |
| 5,336,159 | A | 8/1994 | Cheng | |
| 5,423,102 | A | 6/1995 | Madison | |
| 5,577,324 | A | 11/1996 | Tanaka | |
| 5,891,063 | A | 4/1999 | Vigil | |
| 5,950,268 | A | 9/1999 | Murphy | |
| 6,026,828 | A | 2/2000 | Altshuler | |
| 6,170,108 | B1 | 1/2001 | Knight | |
| 6,443,915 | B1 | 9/2002 | Hwang | |
| 6,471,712 | B2 * | 10/2002 | Burres | A45D 29/14 606/131 |
| 6,684,107 | B1 | 1/2004 | Binder | |

(Continued)

FOREIGN PATENT DOCUMENTS

DE 9102407 U1 7/1991

*Primary Examiner* — Steven O Douglas
(74) *Attorney, Agent, or Firm* — Knobbe Martens Olson & Bear LLP

(57) ABSTRACT

A Handheld Motorized Facial Brush Having Three Floating Heads. The motorized device can generate rotational, oscillating or vibrating motion at a plurality of micro-treatment heads. The microheads are interchangeable and selectable from a group including bristle brushes, sponge applicator, silicone massage finger/element, among others. The device has a detachable three-headed treatment head assembly that interlocks to the main handle housing by twist-lock or other mechanism. The treatment head assembly may have the option of being pivotally attached to the handle housing in order to allow it to closely follow the contours of the user's face. Finally, the device has internal batteries that are rechargable.

14 Claims, 7 Drawing Sheets

(56) References Cited

U.S. PATENT DOCUMENTS 6,722,038 B2 * 4/2004 Visman ..... B26B 19/14 30/43.6
7,194,316 B2 3/2007 Bousfield et al.
7,258,675 B2 8/2007 Nichols
D549,964 S 9/2007 Roth et al.
7,306,569 B2 12/2007 LaJoie
7,320,691 B2 1/2008 Pilcher
7,331,964 B2 2/2008 Mariele et al.
7,370,420 B2 5/2008 Shimizu
7,386,906 B2 6/2008 Roth et al.
7,384,405 B2 8/2008 Rhoades
D612,612 S 3/2010 Harris et al.
7,707,674 B2 5/2010 Schonewille et al.
7,743,508 B2 6/2010 Shimizu, III
7,748,070 B2 7/2010 Chan et al.
7,789,092 B2 9/2010 Akridge et al.
7,810,201 B2 10/2010 Braun
7,937,792 B2 5/2011 Munn
8,157,753 B2 4/2012 Nichols
8,393,082 B2 * 3/2013 Shimizu ..... B26B 19/14 30/43.5
D693,932 S 11/2013 Nichols
D700,316 S 2/2014 Nichols
8,696,605 B2 4/2014 Nichols
D713,971 S 9/2014 Nichols
D736,399 S 8/2015 Nichols
D738,508 S 9/2015 Nichols
9,272,141 B2 3/2016 Nichols
D764,173 S 8/2016 Nichols
D765,982 S 9/2016 Nichols
D774,774 S 12/2016 Nichols
9,579,250 B2 2/2017 Nichols
9,592,614 B2 * 3/2017 Oosterhoff ..... B26B 19/146
D803,572 S 11/2017 Nichols
9,919,437 B2 * 3/2018 Veltman ..... B26B 19/146
2002/0156402 A1 * 10/2002 Woog ..... A61H 23/0236 601/46
2002/0157257 A1 10/2002 Oswald
2004/0147984 A1 7/2004 Altshuler et al.
2005/0075149 A1 4/2005 Gerber et al.
2005/0199265 A1 9/2005 France et al.
2006/0047234 A1 3/2006 Glucksman et al.
2006/0058714 A1 3/2006 Rhoades
2006/0066996 A1 3/2006 Ishiguro
2006/0168746 A1 8/2006 Guyuron et al.
2006/0253051 A1 11/2006 Milne et al.
2007/0123808 A1 5/2007 Rhoades
2007/0124936 A1 * 6/2007 Okabe ..... B26B 19/14 30/43.6
2007/0198004 A1 8/2007 Altshuler et al.
2007/0239143 A1 10/2007 Altshuler et al.
2008/0119913 A1 5/2008 Powell et al.
2008/0214968 A1 9/2008 Milne et al.
2008/0243039 A1 10/2008 Rhoades
2009/0069728 A1 3/2009 Hoffmann et al.
2009/0177125 A1 7/2009 Pilcher et al.
2009/0217471 A1 9/2009 Weinberger
2009/0312691 A1 12/2009 Kim et al.
2010/0049177 A1 2/2010 Boone et al.
2010/0121419 A1 5/2010 Douglas
2010/0210993 A1 8/2010 Fyash et al.
2010/0274329 A1 10/2010 Bradley et al.
2010/0275446 A1 11/2010 Schmitt et al.
2010/0292746 A1 11/2010 Gorham
2011/0030220 A1 2/2011 Shimizu, III
2011/0098781 A1 4/2011 Mantle et al.
2011/0184499 A1 4/2011 Radi
2011/0106067 A1 5/2011 Geva et al.
2011/0138563 A1 6/2011 Phgura
2012/0165710 A1 7/2012 Nichols
2013/0023901 A1 * 1/2013 Sanchez-Martinez ..... A46B 13/008 606/133
2013/0046212 A1 2/2013 Nichols
2013/0060176 A1 3/2013 Nichols
2014/0330289 A1 * 11/2014 Revivo ..... A61B 17/54 606/131
2014/0336565 A1 11/2014 Nichols
2015/0305969 A1 * 10/2015 Giraud ..... A61H 7/005 601/18
2017/0013932 A1 1/2017 Nichols
2017/0119220 A1 5/2017 Nichols
2017/0202732 A1 7/2017 Nichols
2018/0125201 A1 5/2018 Nichols
2018/0193219 A1 * 7/2018 Hashimoto ..... A61H 7/007

* cited by examiner

HANDHELD MOTORIZED FACIAL BRUSH HAVING THREE FLOATING HEADS

This application is filed within one year of, and claims priority to Provisional Application Ser. No. 62/072,904, filed Oct. 30, 2014.

This application is a continuation-in-part of application Ser. No. 13/603,081, filed Sep. 4, 2012; status: Now Pending—hereinafter referred to as the "parent" application.

BACKGROUND OF THE INVENTION

1. Field of the Invention

This invention relates generally to skin care appliances and, more specifically, to a Handheld Motorized Facial Brush Having Three Floating Heads.

2. Description of Related Art

Facial massage, cleansing, treatment and exfoliation devices have become widely available for home use. Despite their wide variety, there remains to be a multi-headed brush/massage device for preparing a man's face for shaving. Some relevant examples of prior devices are described below.

Glucksman, et al., U.S. Pat. No. 7,270,641 for "Apparatus for Abrading Hair and Exfoliating Skin" describes a handheld device having three rotating disks. Each disk is configured with a covering of hook-and-loop fastener material for engaging abrasive pads. The pads are designed for removing hair and abrading the skin. The Glucksman device has individually "floating" heads that are permanently attached to the drive housing. The disks are not removeable from the housing/drive mechanism, nor do they float as an assembly on a single drive shaft. Furthermore, Glucksman would not work with brush or sponge applicators, because neither is functional with the hook-and-loop fastener attachment system.

Podolsky, U.S. Pat. No. 5,725,483 for "Massaging Device" is a motorized device having three rotating/translating balls for the application of shaving cream. The Podolsky device, however, does not suggest the use of brushes or sponges, nor does it include interchangeable and/or floating treatment heads.

Tsang, U.S. Pat. No. 6,032,313 for "Household Applicance . . . " describes a motorized brush having concentric rotating brush rings, or side-by-side translating brushes. While the heads are detachable, they do not float as a single assembly, nor are each heads rotating separate from one another.

DeLuca et al., U.S. Pat. No. 5,103,809 for "Massaging Device" that has a plurality of rotating massage fingers dispersed around a stationary massage head, or stationary fingers dispersed around a rotating massage head. While the head is interchangeable, it does not float as an assembly. Furthermore, the "massage fingers" are not detachable from the massage head. There is further no suggestion of using bristle brushes or sponges in place of the elongate massage fingers.

SUMMARY OF THE INVENTION

In light of the aforementioned problems associated with the prior devices, it is an object of the present invention to provide a Handheld Motorized Facial Brush Having Three Floating Heads. The motorized device should be able to generate rotational, oscillating or vibrating motion at a plurality of micro-treatment heads. The microheads should be interchangeable, and be selectable from a group including bristle brushes, sponge applicator, silicone massage finger/element, among others. The device should have a detachable three-headed treatment head assembly that interlocks to the main handle housing by twist-lock or other mechanism. The treatment head assembly should have an option of being pivotally attached to the handle housing in order to allow it to closely follow the contours of the user's face. Finally, the device should have internal batteries that are rechargable.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Handheld Motorized Facial Brush Having Three Floating Heads.

Figure 1:
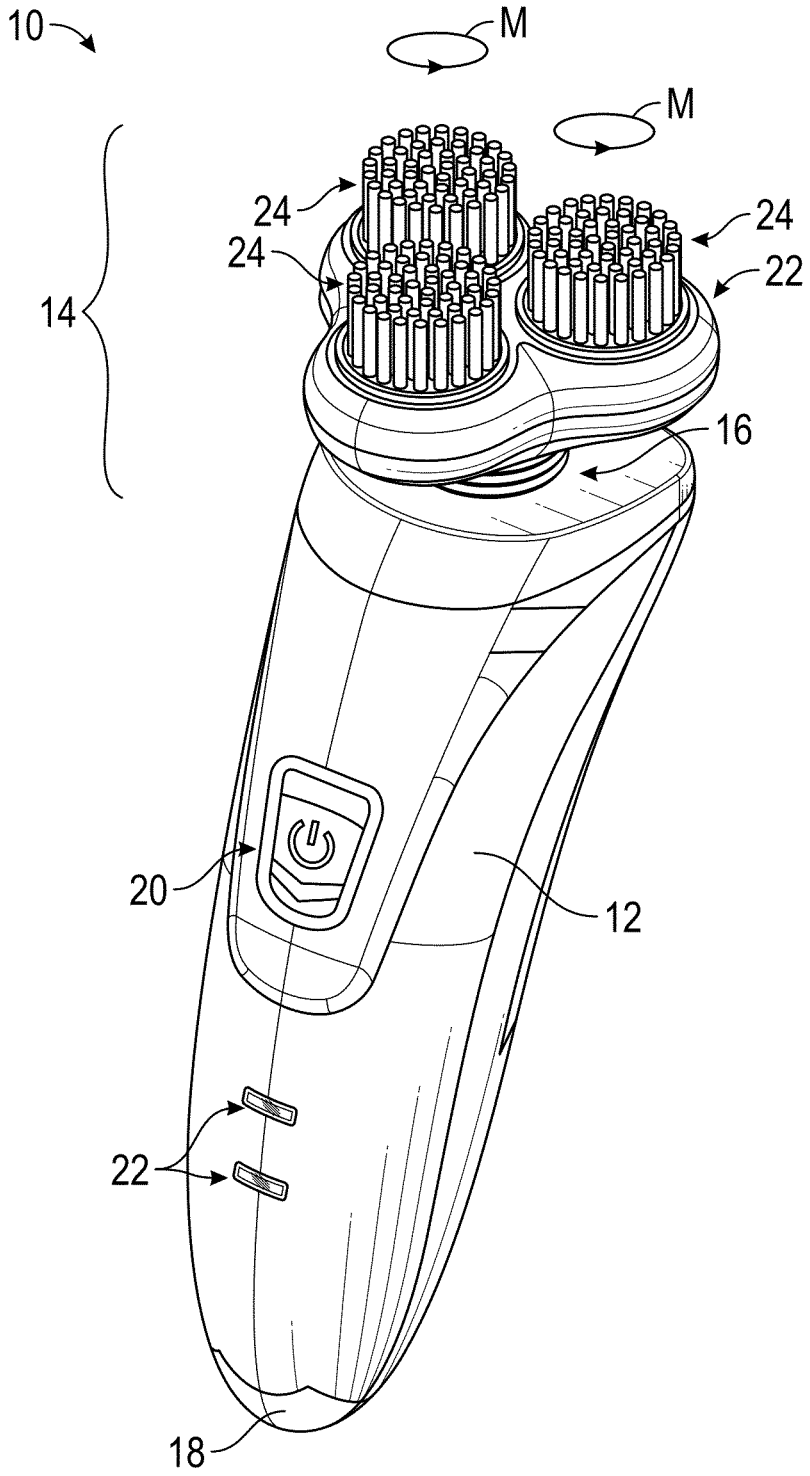
FIG. 1 is a front perspective view of a preferred embodiment of the handheld motorized facial brush having floating heads of the present invention.

The present invention can best be understood by initial consideration of FIG. 1.[1] FIG. 1 is a front perspective view of a preferred embodiment of the handheld motorized facial brush having floating heads 10 of the present invention. While it is entitled "brush," it must be understood that the device 10 can comprise a plurality of brushes as shown, but also sponges, silicone massaging elements, and other treatment elements.

[1] As used throughout this disclosure, element numbers enclosed in square brackets [ ] indicates that the referenced element is not shown in the instant drawing figure, but rather is displayed elsewhere in another drawing figure.

The device 10 has two main parts or assemblies: the main housing 12, within which the power supply and drive motor are housed (and the controllers/displays therefor), and the treatment head assembly 14, which receives rotational input from the drive motor (not shown) through the motor drive interface 16 extending from the main housing 12.

The main housing 12 preferably has a charging socket at its tip 18 to charge the internal batteries. Control switch 20 allows the user to turn on and off the operating features of the device 10. The device 10 may provide rotational output at the treatment head assembly 14, as well as oscillating motion, and simple vibration of the assembly 14 (or some combination of these features, depending on user selection by the control switch 20). The indicator lights 22 provide the user with a display indicating the operating mode of the device, and perhaps the battery/charging status.

Figure 2:
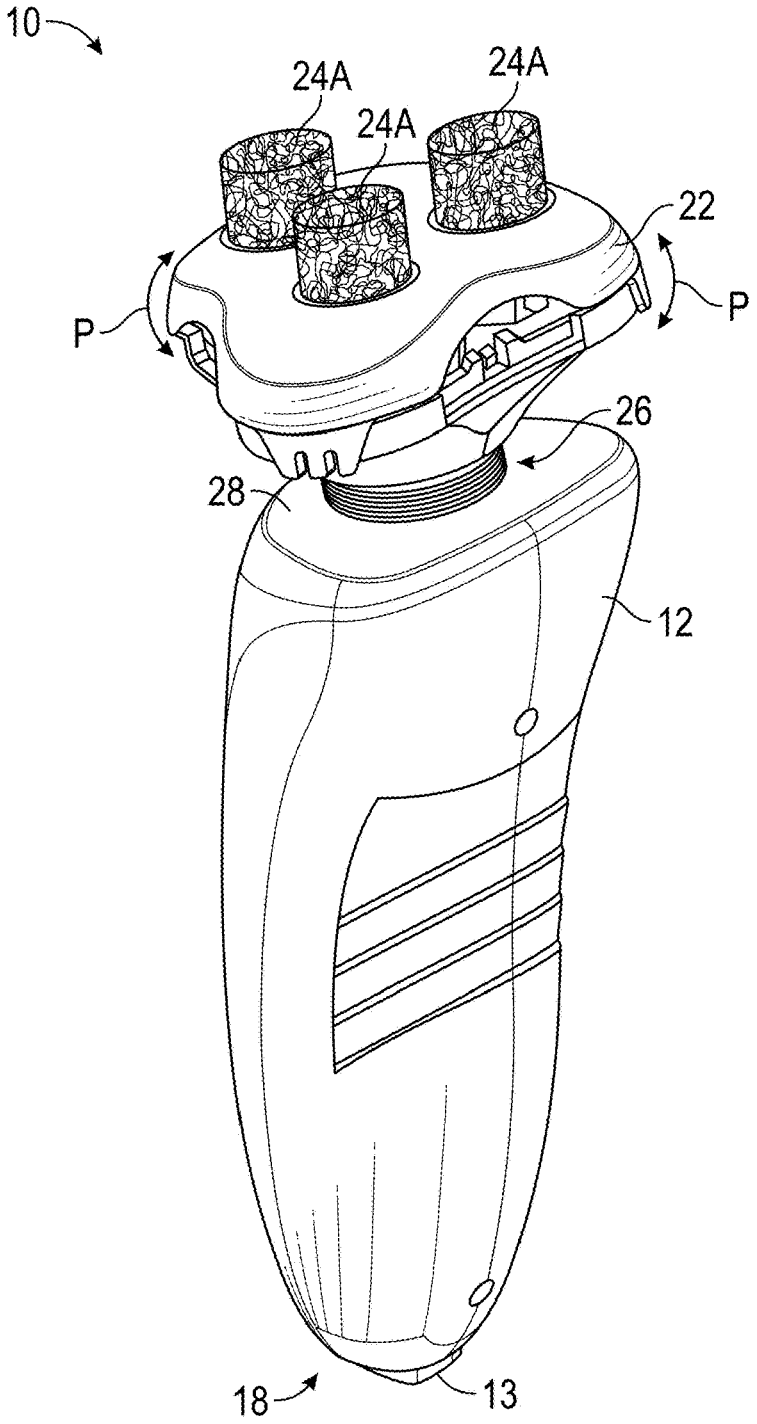
FIG. 2 is a rear perspective view of the device of FIG. 1.

The treatment head assembly 14 receives rotational or oscillating input from the motor drive interface 16. Gearing within the treatment head base 22 transfers the mechanical input from the interface 16 and splits it into the three microheads 24 shown, so that the microheads 24 rotate in direction "M" (or oscillate, etc.). The treatment head base 22 remains stationary while the microheads 24 move, however, the interface 16 may allow for the treatment head assembly 14 to pivot or float relative to the main housing 12, in order that the microheads 24 can more adequately follow the contours of the user's face. The structure facilitating the pivoting/floating will be selected from one of the designs disclosed in the Parent Application—the disclosures therein being incorporated herein by reference. FIG. 2 provides additional detail regarding this novel device 10.

Figure 3A:
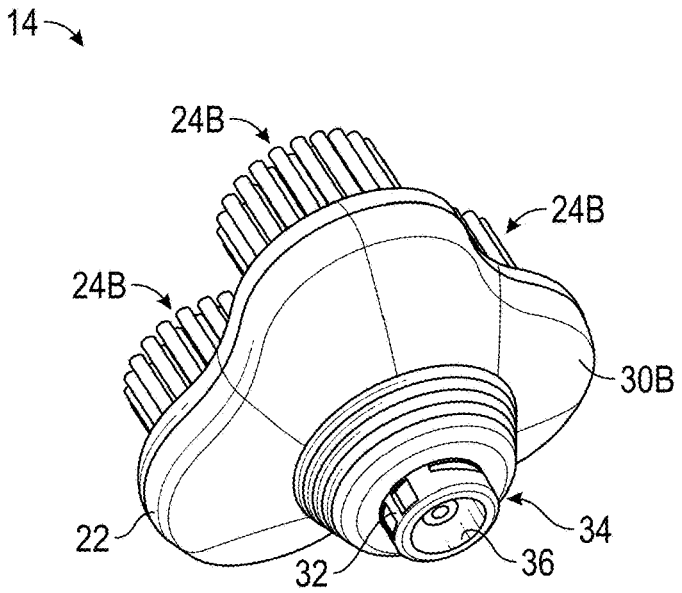
FIG. 3A is rear perspective view.
Figure 3B:
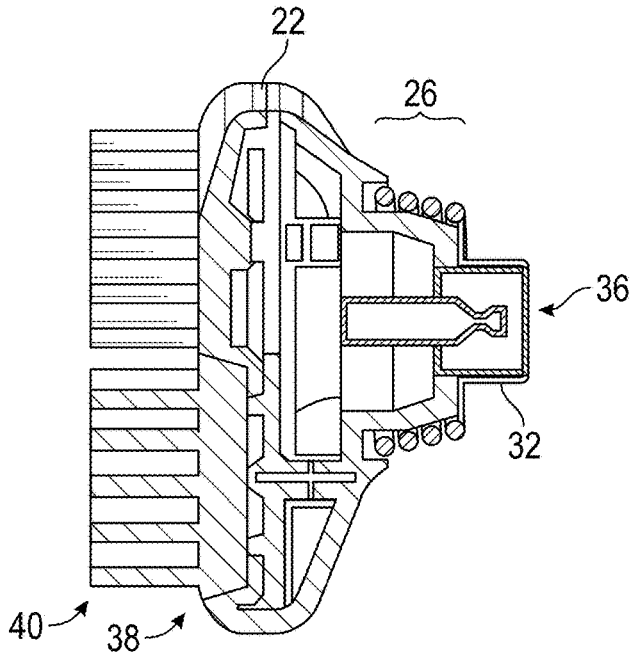
FIG. 3B is a cutaway side view.
Figure 3C:
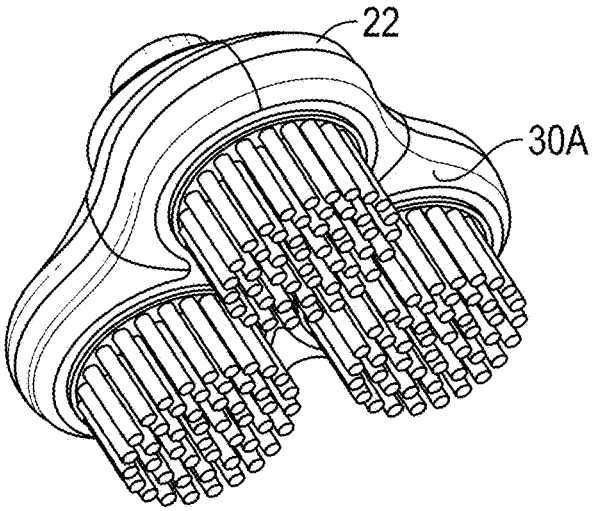
FIG. 3C is a front perspective view of the device of FIGS. 1 and 2.

FIG. 2 is a rear perspective view of the device 10 of FIG. 1. Here, sponge microheads 24A have been installed on the base 22. Sponges 24A may be preferred where a less aggressive massage/conditioning experience is desired. A pivot subassembly 26 (from the Parent Application) extends from the top of the housing through the shoulder face 28. The pivot subassembly 26 will permit the base 22 to tilt/float in direction "P," when the device 10 has the integrated pivot assembly 26 (an optional feature). The electrical socket 13 is preferably provided at the tip 18 of the main housing 12. FIG. 3 provides additional detail regarding the features of this invention.

FIG. 3 are perspective and cutaway side views of the treatment head assembly 22 of the device [10] of FIGS. 1 and 2. In this depiction, brush microheads 24B have been attached to the base 22 of the assembly 14. The pivot assembly 26 extends from the rear housing 30B and terminates in interlock sleeve 32. The interlock sleeve 32 is cooperatively designed to be attachable to a corresponding structure extending from the shoulder face [28] of the main housing [12]. A twist-lock and twist-unlock design has been found to be suitable for this structure, however other designs that do not permit rotation between the housing [12] and the treatment head assembly 14 are also likely to be acceptable.

The interlock sleeve 32 may have interlock slots 34 formed therein (to interact with structure on the housing [12]. Drive shaft 36 is centered within the interlock sleeve 32. The drive shaft 36 engages the motor drive interface [16] such that motion of the motor drive (not shown) will also drive the shaft 36 to cause the microheads [24] to rotate/oscillate/vibrate.

The microheads 24B extend from the front housing 30A, and are comprised of a plurality of bristle elements 40 extending from a microhead base 38. Whether the microheads are sponge, silicone or other structure, they all have the same microhead base 38 (at least as it applies to their engagement with the drive mechanism described in FIG. 4.

Figure 4:
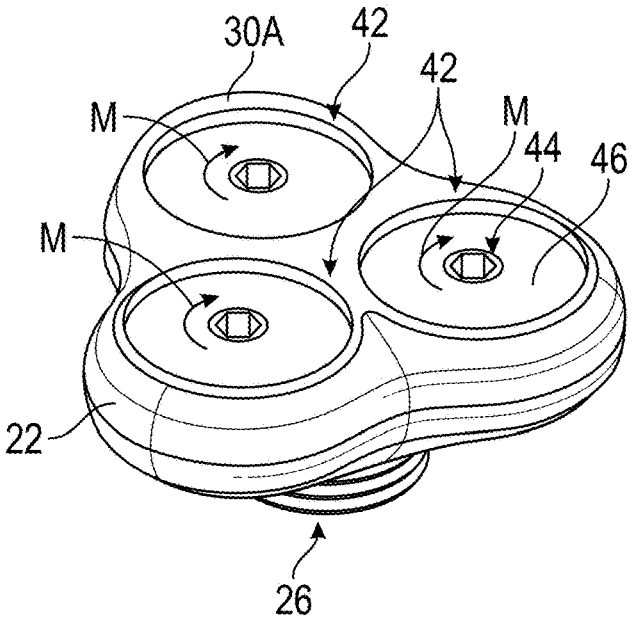
FIG. 4 is a perspective view of the treatment head base of FIG. 3.

FIG. 4 is a perspective view of the treatment head base 22 of FIG. 3. The front housing 30A has a plurality of microhead receptacles 42 formed in it. Each receptacle 42 has a recessed micro face 46, which is sized to accept the microhead base [38] within it. Centered on each face 46 is a microdrive socket 44. The microdrive sockets 44 all rotate/oscillate/vibrate "M" in response to the input from the drive system [49] of FIG. 5.

Figure 5:
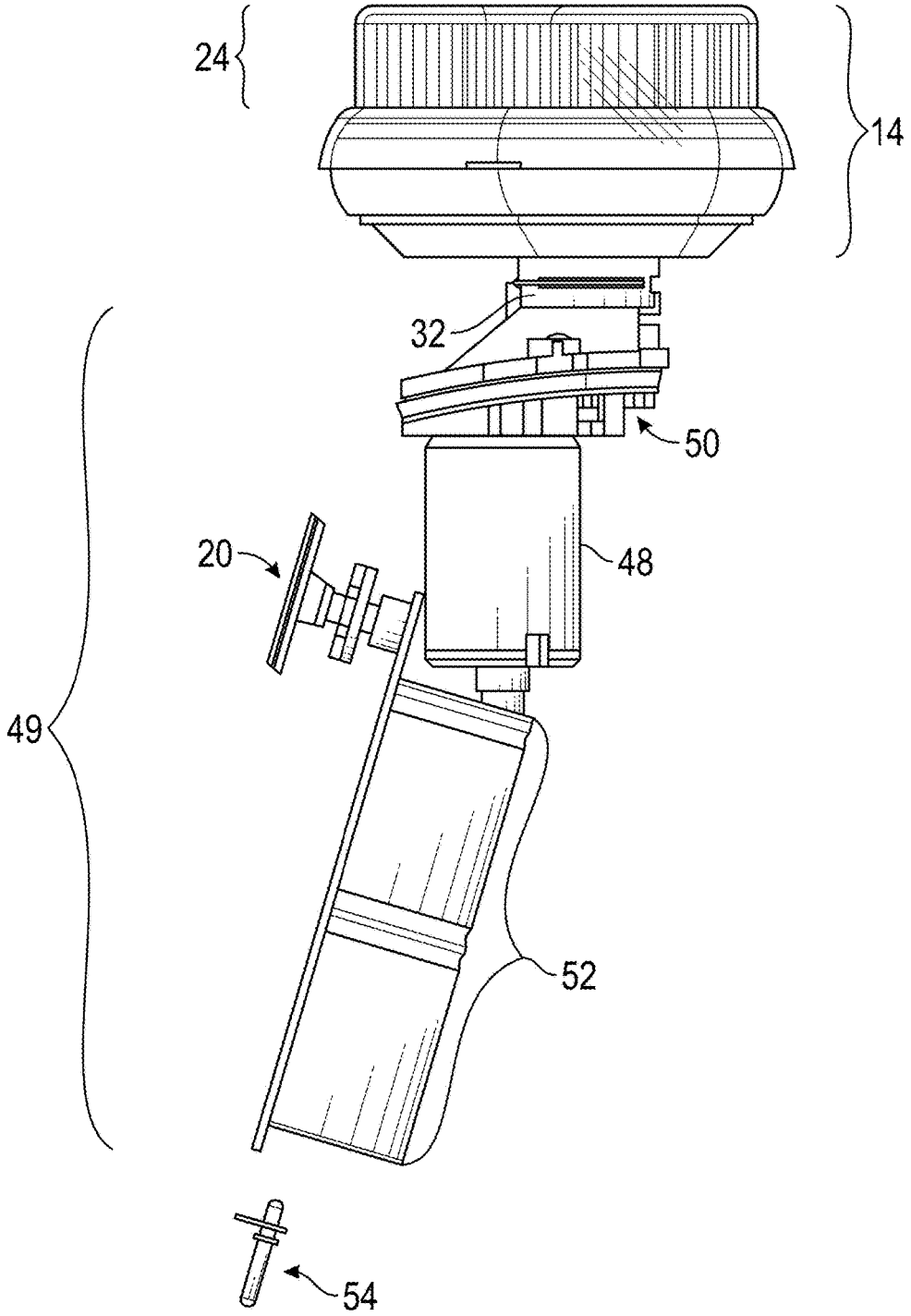
FIG. 5 is a cutaway side view of the motor and battery components of the device of FIGS. 1 and 2.

FIG. 5 is a cutaway side view of the motor and battery components of the device of FIGS. 1 and 2. These components collectively make up the drive subsystem 49. An electric drive motor 48 is mechanically connected to drive gear assembly 50 which translates the rotational output of the motor 48 shaft into rotation/oscillation/vibration in the appropriate magnitude and speed. The resultant mechanical motion is tranferred to the treatment head assembly through the motor drive interface [16] (within the interlock sleeve 32).

Control switch 20 activates the different operational modes of the drive motor 48. The internal batteries 52 power the motor 48. The batteries 52 are recharged by charging probe 54, which extends through the electrical socket [13] at the tip [18] of the main housing [12].

Figure 6:
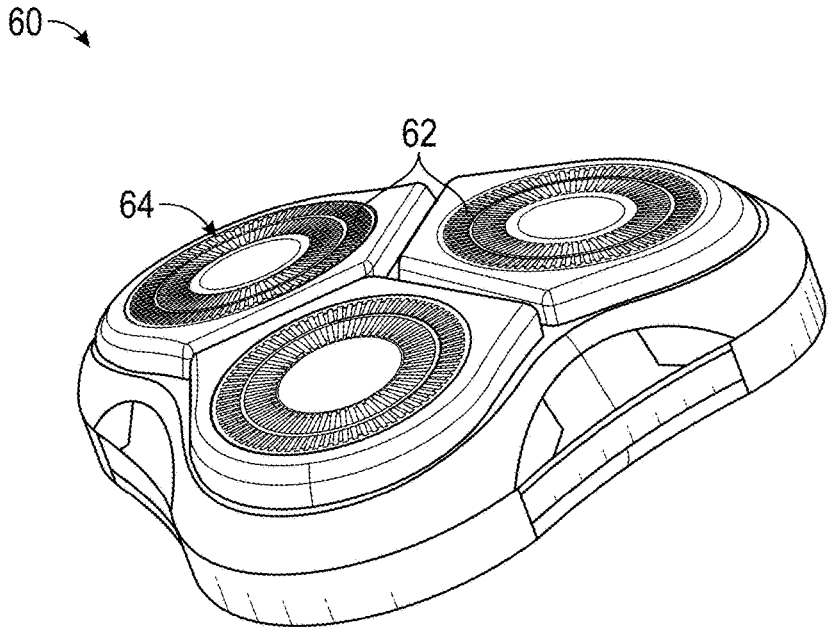
FIG. 6 PRIOR ART
FIG. 6 is a perspective view of a conventional rotary shaver head assembly.
Figure 7A:
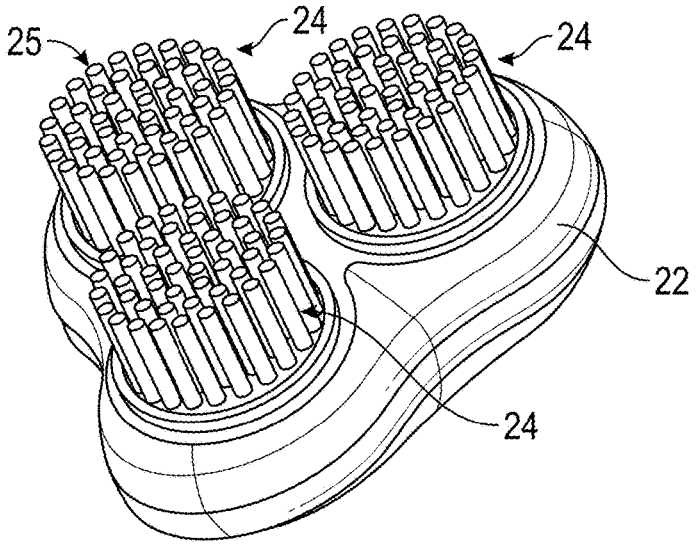
FIGS. 7A-7C are perspective views of preferred embodiments of the members of the group of microheads attachable to the device of FIG. 1.
Figure 7B:
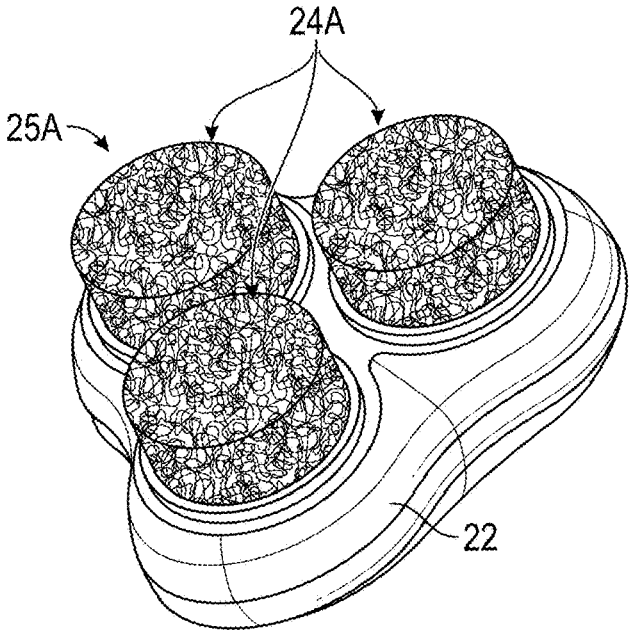
Figure 7C:
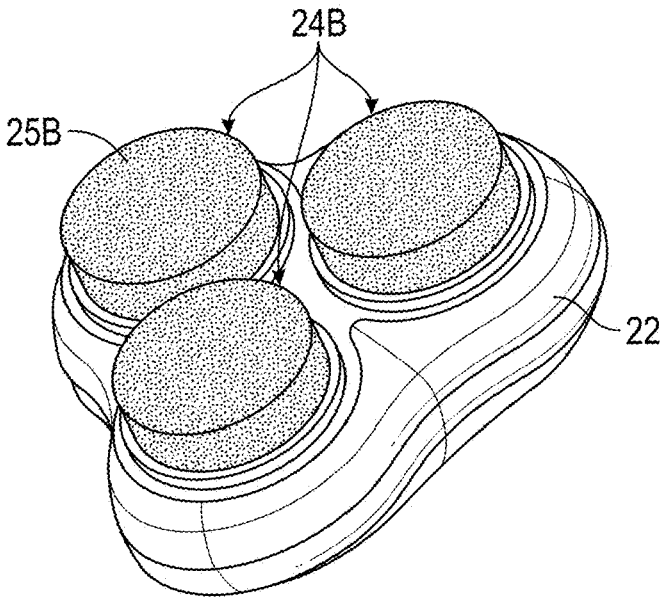

FIG. 6 is a perspective view of a conventional rotary shaver head assembly 60, that is provided in order to highlight an essential structural distinction between the prior art devices and the facial treatment device [10] of the present invention. For safety reasons, the rotating cutter blades 64 are each covered by a stationary face element 62. The face elements 62 are formed with perforations (slots or holes) through them so that the cutter blades 64 do not actually come in contact with the user's skin as they rotate or oscillate (which would of course cut the user's skin). While the user's hair is intended to protrude through the perforations, the face elements 62 are not activated to move by the shaver motor. FIGS. 7A-7C illuminate the contrast between these stationary face elements 62 and the moving face elements of Applicant's claimed design.

FIGS. 7A-7B are perspective views of preferred embodiments of the members of the group of microheads attachable to the device [10] of FIG. 1. The bristle brush microheads 24 each define a face 25 composed of the ends of the brush bristles (for cleansing and massaging the skin). The sponge microheads 24A each define a face 25A composed of the sponge material (for applying lotions or creams to the skin). The silicone microheads 24B each define a face 25B that is coated with a silicone material (for smoothing and massaging the skin). Unlike the faces 62 of the shaver head assembly 60, each of these faces 25, 25A, 25B are driven to move by the internal drive motor [48]. The motion of the microheads 24, 24A, 24B is synchronous rotation, oscillation or vibration (very small incremental movements) that allow the user to massage/cleanse/treat their skin.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A skin treatment device, comprising:

a handpiece defined by an internal motor driving a drive gear assembly to rotationally move a motor drive shaft, said motor drive shaft extending from a head portion of said handpiece;

and a treatment head assembly attachable to said head portion, said treatment head assembly comprising:

a base comprising a base first face;

an interlock sleeve extending from said base first face;

a head drive shaft extending from said base first face; and three or more microdrive interface elements disposed on a second face of said base, each of said three or more microdrive interface elements being interconnected to said head drive shaft, whereby rotating said head drive shaft causes each of said three or more microdrive interface elements to cooperatively rotate; and a microhead element attachable to each of said three or more microdrive interface elements.

2. The skin treatment device of claim 1, wherein said treatment head assembly further comprises a pivot subassembly, said pivot subassembly permitting pivoting movement between said second face and said head drive shaft.

3. The skin treatment device of claim 2, wherein said interlock sleeve is further defined by one or more interlock slots formed therein for engaging with an interlock element on said head portion of said handpiece to prevent said interlock sleeve from rotating relative thereto.

4. The treatment device of claim 3, wherein said microhead element comprises:

a microbase defined by a first face and a second face, said first face cooperatively formed to be attachable to a one of said three or more microdrive interface elements; and a microtreatment element extending from said second face of said microbase, said microtreatment element selected from the group consisting of:

a plurality of bristles;

a sponge-like element; and a silicone-coated element.

5. The treatment device of claim 4, wherein said plurality of bristles defines an outer face comprising a distal end of each of said plurality of bristles.

6. The treatment device of claim 4, wherein said sponge-like element defines an outer face of said microtreatment element.

7. The treatment device of claim 4, wherein said silicone-coated element defines an outer face of said microtreatment element, wherein said outer face comprises silicone, rubber or plastic material.

8. A device for treating a user's skin prior to shaving, comprising:

a handpiece;

a treatment head assembly attachable to said handpiece, whereby said treatment head assembly can pivotally move relative to said handpiece when attached thereto, said treatment head assembly comprising:

a base comprising a base first face;

an interlock sleeve extending from said base first face;

a head drive shaft extending from said base first face; and three or more microdrive interface elements disposed on a second face of said base, each of said three or more microdrive interface elements being interconnected to said head drive shaft, whereby rotating said head drive shaft causes each of said three or more microdrive interface elements to cooperatively rotate; and a microhead element attachable to a one of said three or more microdrive interface elements; and three or more microtreatment heads extending from said treatment head assembly, each of said three or more microtreatment heads comprising said microtreatment element extending therefrom and selected from the group consisting of:

a plurality of bristles;

a sponge-like element; and a silicone-coated element.

9. The treatment device of claim 8, wherein said plurality of bristles defines an outer face comprising a distal end of each of said plurality of bristles.

10. The treatment device of claim 8, wherein said sponge-like element defines an outer face of said microtreatment element.

11. The treatment device of claim 8, wherein said silicone-coated element defines an outer face of said microtreatment element, wherein said outer face comprises silicone, rubber or plastic material.

12. The device of claim 8, wherein said microhead elements comprise:

a microbase defined by a first face and a second face, said first face cooperatively formed to be attachable to a one of said three or more microdrive interface elements; and said microtreatment element extending from said second face of said microbase.

13. A method for treating the skin, comprising the steps of:

obtaining a skin treatment device, the skin treatment device, comprising:

a handpiece having an internal drive motor;

a treatment head assembly attachable to said handpiece, said treatment head assembly comprising a base comprising a base first face, said treatment head further comprising an interlock sleeve extending from said base first face, a head drive shaft extending from said base first face, three or more microdrive interface elements disposed on a second face of said base, and a microhead element attachable to a one of said three or more microdrive interface elements, each of said three or more microdrive interface elements being interconnected to said head drive shaft, whereby rotating said head drive shaft causes each of said three or more microdrive interface elements to cooperatively rotate, whereby said treatment head assembly can pivotally move relative to said handpiece when attached thereto; and three or more microtreatment heads extending from said treatment head assembly, each of said three or more microtreatment heads comprising a microtreatment element extending therefrom defined by a face and selected from the group consisting of:

a plurality of bristles;

a sponge-like element; and a silicone-coated element;

placing said face against the skin; and activating said drive motor to drive said face to move rotationally.

14. The device of claim 13, wherein said three or more microhead elements of said obtaining step comprise:

a microbase defined by a first face and a second face, said first face cooperatively formed to be attachable to a one of said three or more microdrive interface elements; and said microtreatment element extending from said second face of said microbase.

* * * * *